US006699160B1

(12) United States Patent
Pan et al.

(10) Patent No.: US 6,699,160 B1
(45) Date of Patent: Mar. 2, 2004

(54) INCLINATION MECHANISM FOR A TREADMILL

(75) Inventors: John C. Pan, Taichung (TW); Hung-Lung Uen, Taichung (TW); Shih-Huang Chu, Taichung (TW)

(73) Assignee: Forhouse Corporation, Taichung Hsien (TW)

( * ) Notice: Subject to any disclaimer, the term of this patent is extended or adjusted under 35 U.S.C. 154(b) by 0 days.

(21) Appl. No.: 10/376,731

(22) Filed: Feb. 28, 2003

(51) Int. Cl.[7] ..... A63B 23/06
(52) U.S. Cl. ..... 482/54
(58) Field of Search ..... 482/54, 51–53, 482/57, 148

(56) References Cited

U.S. PATENT DOCUMENTS 5,184,988 A * 2/1993 Dunham ..... 482/54
5,967,945 A * 10/1999 Wang ..... 482/54
6,033,346 A * 3/2000 Wang et al. ..... 482/54
6,475,121 B2 * 11/2002 Wang et al. ..... 482/54
6,569,062 B2 * 5/2003 Wang et al. ..... 482/54

* cited by examiner

*Primary Examiner*—Stephen R. Crow
(74) *Attorney, Agent, or Firm*—Alan Kamrath

(57) ABSTRACT

An inclination mechanism for a treadmill having a tread assembly and a front base assembly has a lever arm, a chassis, an actuating assembly, The lever arm has a cross member with a center and two coupling arms pivotally attached to the front of the tread frame. Each coupling arm is pivotally attached to a post of the base frame. The chassis is pivotally attached to a cross bar of the base frame. The actuating assembly has a drive rod and is mounted on the chassis. The drive rod is pivotally attached to the cross member of the lever arm, such that extending or retracting the drive rod causes the lever arm to raise or lower the coupling ends of the coupling arms to increase or decrease the inclination of the tread assembly.

5 Claims, 8 Drawing Sheets

INCLINATION MECHANISM FOR A TREADMILL

BACKGROUND OF THE INVENTION

1. Field of the Invention

The present invention relates to an inclination mechanism for a treadmill, and more particularly to an inclination mechanism for a treadmill that can conveniently adjust the inclination of the tread relative to the surface on which the treadmill is sitting.

2. Description of Related Art

A treadmill is a piece of exercise equipment with a rotating tread mounted on a tread frame used by a person to physically exercise by running or jogging in place. However, to accommodate the needs of different people or the changing needs of a single person using a treadmill, the inclination of the tread frame is adjustable. With reference to FIG. 7, a conventional inclination device for a treadmill having a tread frame (60) comprises a front support (61), a coupling (62), a drive screw (63), a drive device (64) and a lever (65). The tread frame (60) has a front (not numbered), and the front support (61) is mounted under the tread frame (60) near the front.

The front support (61) has a front cross bar (611). The coupling (62) has a longitudinal hole (not numbered) and is attached to the front cross bar (611). The drive device (64) is rotatably attached to the coupling (62) and has a threaded longitudinal hole (not shown) aligned with the longitudinal hole in the coupling (62). The drive screw (63) has a rear end (not numbered) and a front threaded end (not numbered). A linkage (not numbered) is rotatably connected to the rear end of the drive screw (63). The front treaded end of the feed screw (63) extends through the longitudinal hole in the coupling (62) and screws through the longitudinal threaded hole in the drive device (64).

The lever (65) is L-shaped, has an upper arm (not numbered) and a lower arm (not numbered). The upper arm and the lower arm are joined at a perpendicular junction. The lever (65) is pivotally connected to the front support (61) at the perpendicular junction of the upper arm and the lower arm. The upper arm is pivotally connected to the tread frame (60) near the front. The lower arm is pivotally connected to the linkage at the rear end of the drive screw (63).

To operate the inclination device, the drive device (64) is turned to axially move the drive screw (63) frontward or rearward. The axial movement of the drive screw (63) pivots the lever (65) that raises or lowers the front of the tread frame (60) to adjust the inclination of the tread frame (60).

However, the conventional inclination mechanism for the treadmill has some shortcomings. First, the drive screw (63) is operated manually by turning the drive device (64). Manual operation of the lever pull (63) is inconvenient and can be difficult. Second, the drive screw (63) is accessible only from the front of the treadmill at a lower position. A person cannot possibly turn the drive device (64) to adjust the inclination of the tread frame (60) while running on the treadmill. Instead, the person must stop running and go to the front of the treadmill to turn the drive device (64). When the person begins running on the treadmill again, the inclination of the tread frame (60) may not be suitable. The person must repeat the process until the inclination of the tread frame (60) is suitable. Repeated adjustment of the conventional inclination mechanism for the treadmill tread frame is inconvenient.

To overcome the shortcomings, the present invention provides an inclination mechanism for a tread frame of a treadmill to mitigate or obviate the aforementioned problems.

SUMMARY OF THE INVENTION

The main objective of the invention is to provide an inclination mechanism for a treadmill tread frame that is convenient to operate.

Another objective of the invention is to provide an inclination mechanism for a treadmill tread frame that uses an electric motor to adjust the inclination of the tread frame such that adjustment of the tread frame inclination is easy for an operator.

Other objectives, advantages and novel features of the invention will become more apparent from the following detailed description when taken in conjunction with the accompanying drawings.

DETAILED DESCRIPTION OF PREFERRED EMBODIMENT

Figure 1:
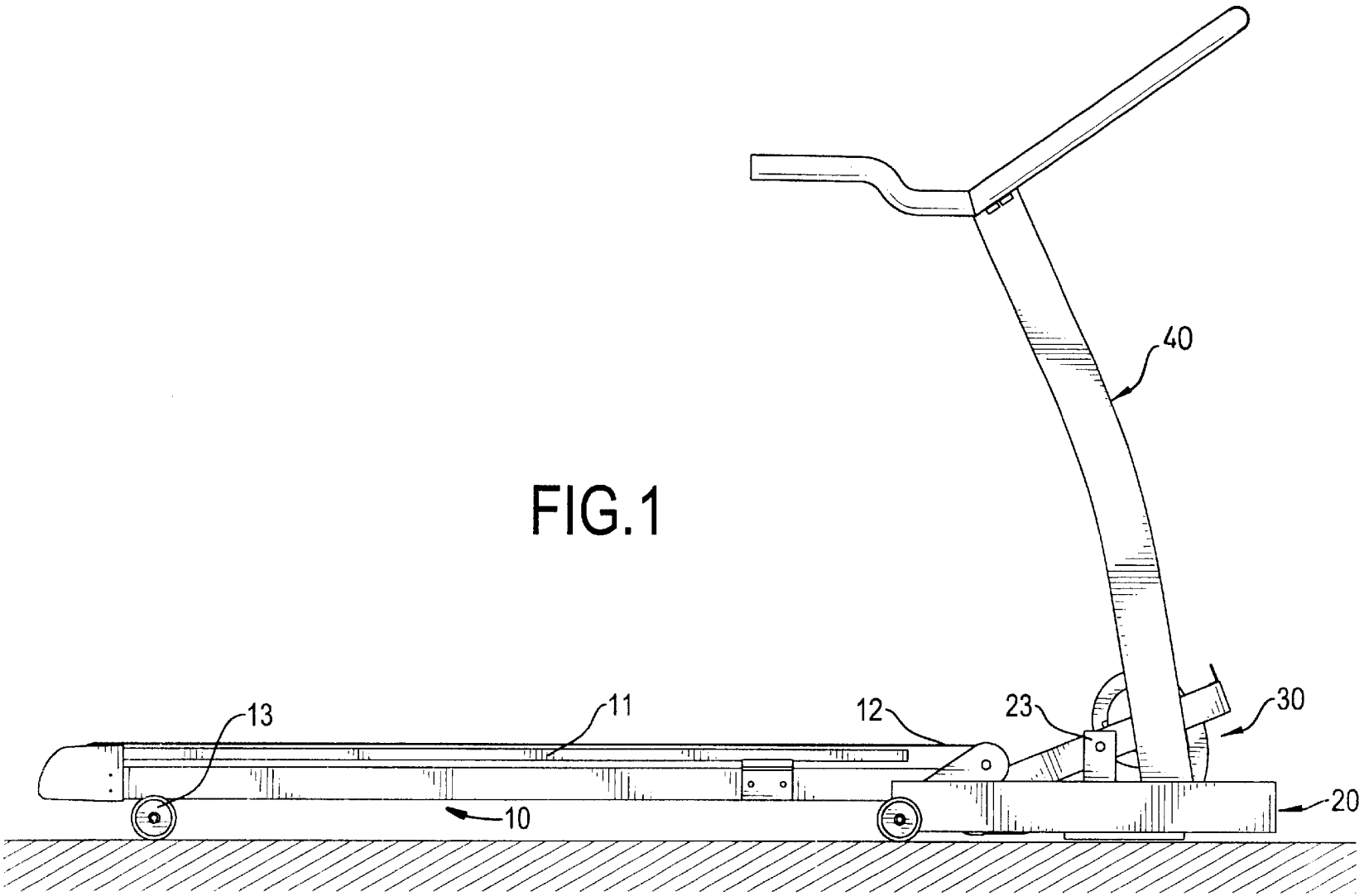
FIG. 1 is a side plan view of a treadmill having an inclination mechanism in accordance with the present invention.

With reference to FIG. 1, a treadmill (not numbered) comprises a tread assembly (10), a base assembly (20), an inclination mechanism (30) and a front support (40). The tread assembly (10) is connected to the base assembly (20) through the inclination mechanism (30) that adjusts the inclination of the tread assembly (10) relative to a surface (not numbered) on which the treadmill is positioned. The front support (40) has a top (not numbered), is mounted in the base assembly (20) in front of the tread assembly (10) and is adapted to support handles (not numbered) and a display (not numbered) at the top of the front support (40).

The tread assembly (10) comprises a tread frame (11), a moving tread (12) and rollers (13). The tread frame (11) has a top (not numbered), a bottom (not numbered), a front (not numbered) and a rear (not numbered). The moving tread (12) is mounted in the tread flame (11) to form a flat moving surface (not numbered) on the top of the tread frame (11) on which a user walks or runs in place. The rollers (13) are respectively mounted on the bottom of the tread frame (11) to conveniently move the tread frame (11).

Figure 2:
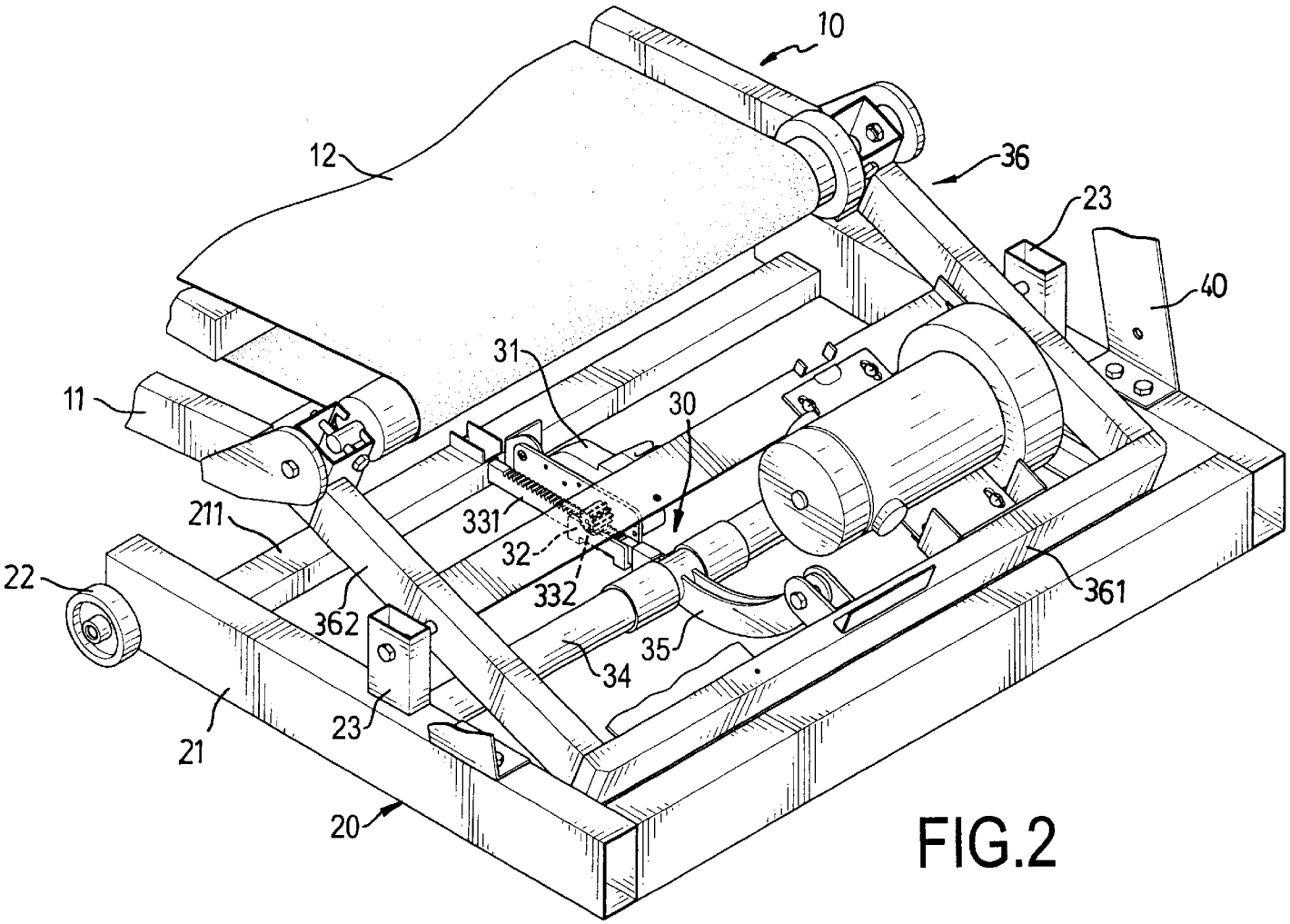
FIG. 2 is an enlarged perspective view of the inclination mechanism in FIG. 1.

With reference to FIG. 2, the base assembly (20) comprises a base frame (21), rollers (22) and two posts (23). The base frame (21) has a cross bar (211), a top (not numbered), a bottom (not numbered), a front (not numbered), a rear (not numbered) and two opposite sides (not numbered). The rollers (22) are respectively mounted on the bottom near the rear of the base frame (21). The posts (23) are respectively mounted on the top of the opposite sides of the base frame (21).

The inclination mechanism (30) in accordance with the present invention is moveably mounted between the tread assembly (10) and the base assembly (20). The inclination mechanism (30) comprises an actuating assembly (not numbered), a chassis (32), an adapter bar (34), a lift rod (35) and a lever arm (36). The chassis (32) has a first side (not numbered) and a second side (not numbered) opposite to the first side and is mounted in the cross bar (211). The actuating assembly is attached to the chassis (32) and comprises a motor (31) and drive rod (not numbered). The motor (31) has a shaft (not shown) and is attached to the first side of the chassis (32). The motor shaft extends through the chassis (32). The drive rod is moveably mounted on the second side of the chassis (32) and is coupled to and driven by the motor shaft to drive the drive rod in either direction, forward or backward. The drive rod can be implemented with a rack (331) and pinion (332) that is attached to the shaft of the motor (31) or the like, such as a worm gear (332') and a worm (331') shown in FIG. 6*b*. Thus, the shaft of the motor (31) can rotate the pinion (332) to move the rack (331) on the second side of the chassis (32).

The rack (33 1) has a front end pivotally connected to the adapter bar (34). The adapted bar (34) has two ends (not numbered) slidably mounted in the base frame (21) at the opposite sides, respectively. The lift rod (35) is curved and has a first end (not numbered) and a second end (not numbered). The first end of the lift rod (35) is pivotally attached to the adapter bar (34) corresponding to the front end of the rack (331). The lever arm (36) has a cross member (361) and two coupling arms (362). The cross member (361) has a center (not numbered). The second end of the lift rod (35) is pivotally attached to the cross member (361) at the center of the cross member (361) of the lever arm (36). Each coupling arm (362) has a coupling end (not numbered) and is respectively pivotally attached to each post (23) of the base frame (21) at a pivot point between the cross member (361) and the coupling end of the coupling arm (362). The coupling ends of the coupling arms (362) are respectively pivotally connected to the front of the tread frame (11).

Figure 3:
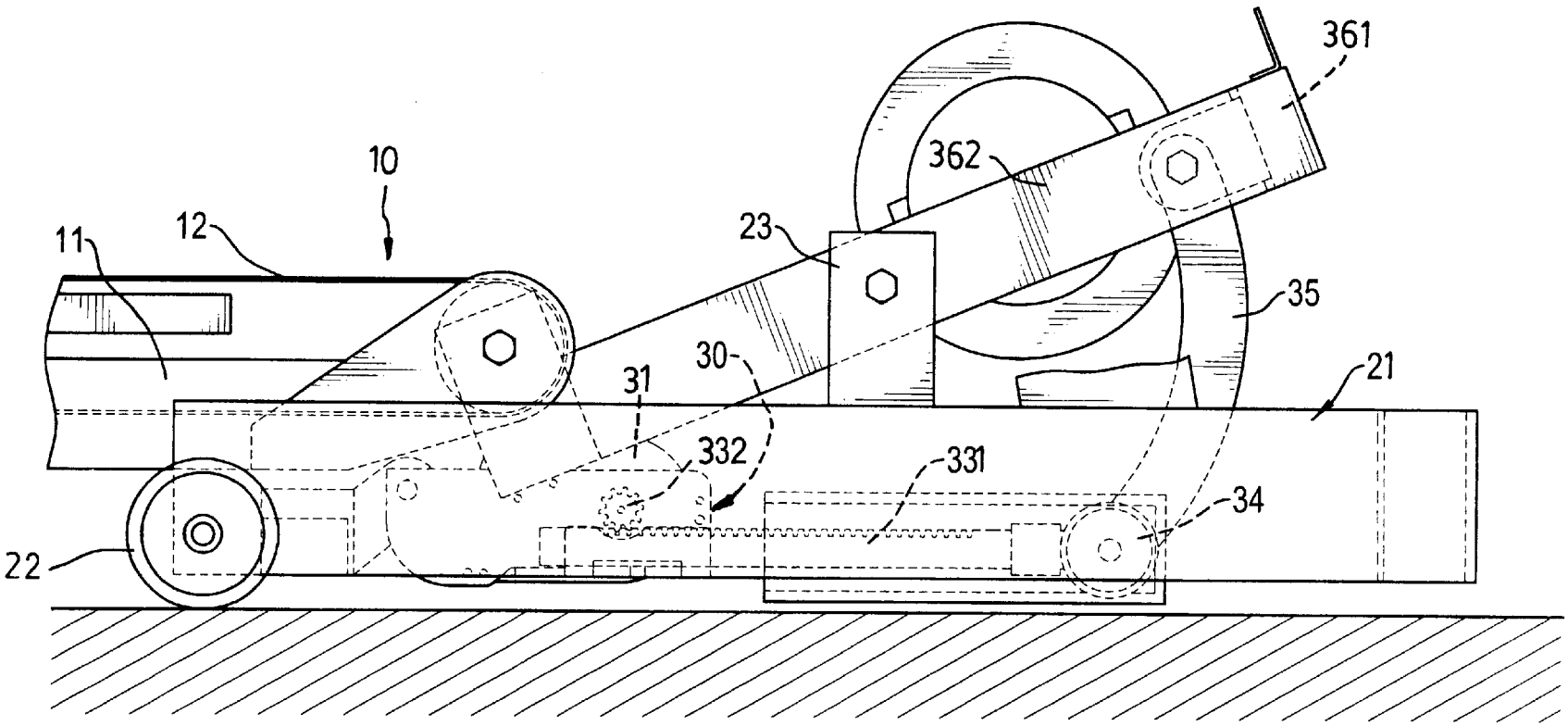
FIG. 3 is an enlarged operational side plan view of the inclination mechanism in FIG. 2 with a minimum tread frame inclination.

With reference to FIG. 3, the motor (31) rotates the pinion (332) that drives the rack (331) forward. The lift rod (35) pushes the cross member (361) of the lever arm (36) and the cross member (361) moves upward. When the cross member (361) moves upward, the coupling ends of the coupling arms (362) will move downward and lower the front of the tread frame (11). As the front of the tread frame (11) moves down, the inclination of the tread assembly (10) is reduced.

Figure 4:
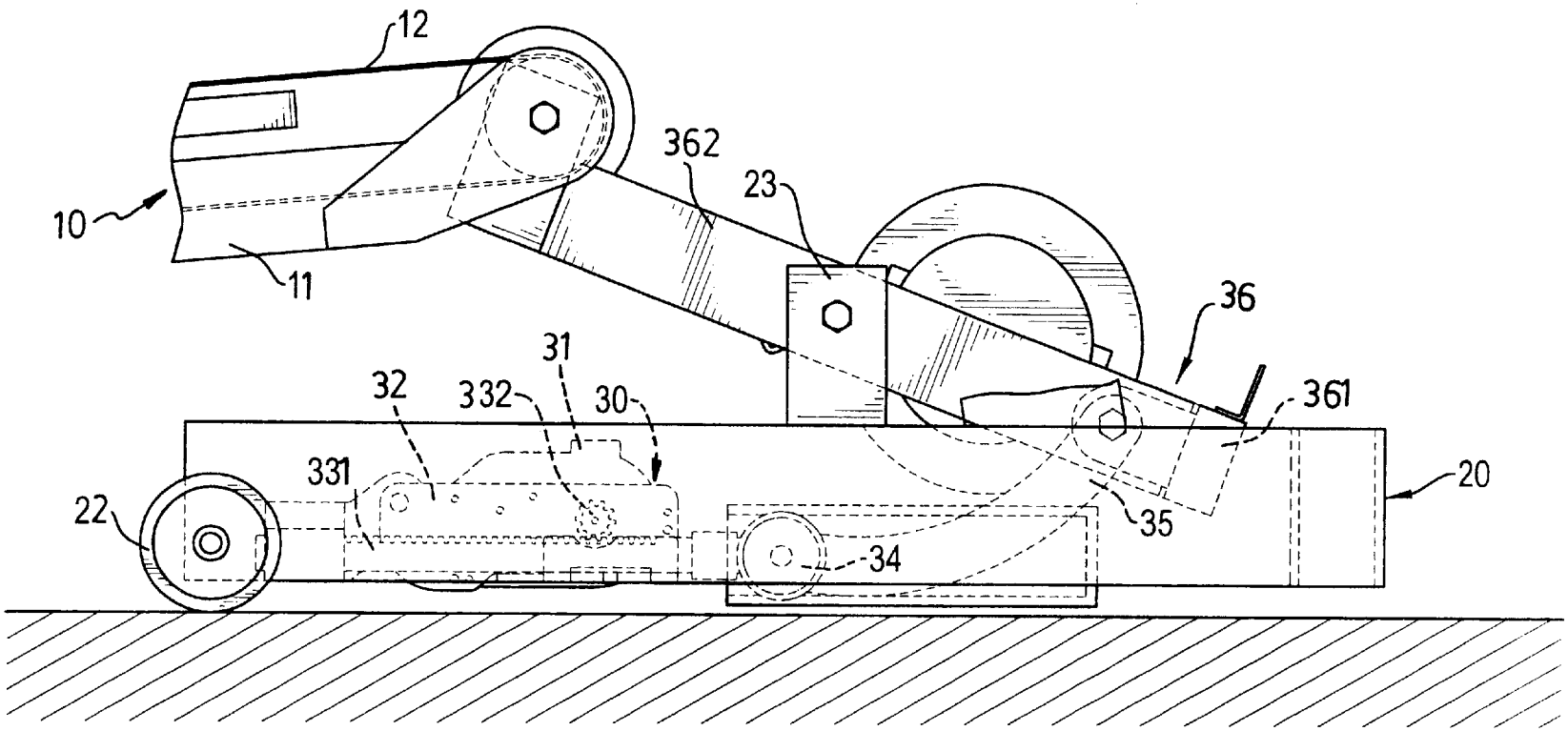
FIG. 4 is an enlarged operational side plan view of the inclination mechanism in FIG. 2 with a maximum tread frame inclination.

With reference to FIG. 4, the motor (31) reverses and rotates the pinion (332) that drives the rack (331) backward. The lift rod (35) pull the cross member (361) of the lever arm (36) downward. When the cross member (361) moves down, the coupling ends of the coupling arm (362) on the seesaw-like lever arm (36) will lift up and raise the front of the tread frame (11). As the front of the tread frame (11) moves up, the inclination of the tread assembly (10) is increased.

Figure 5:
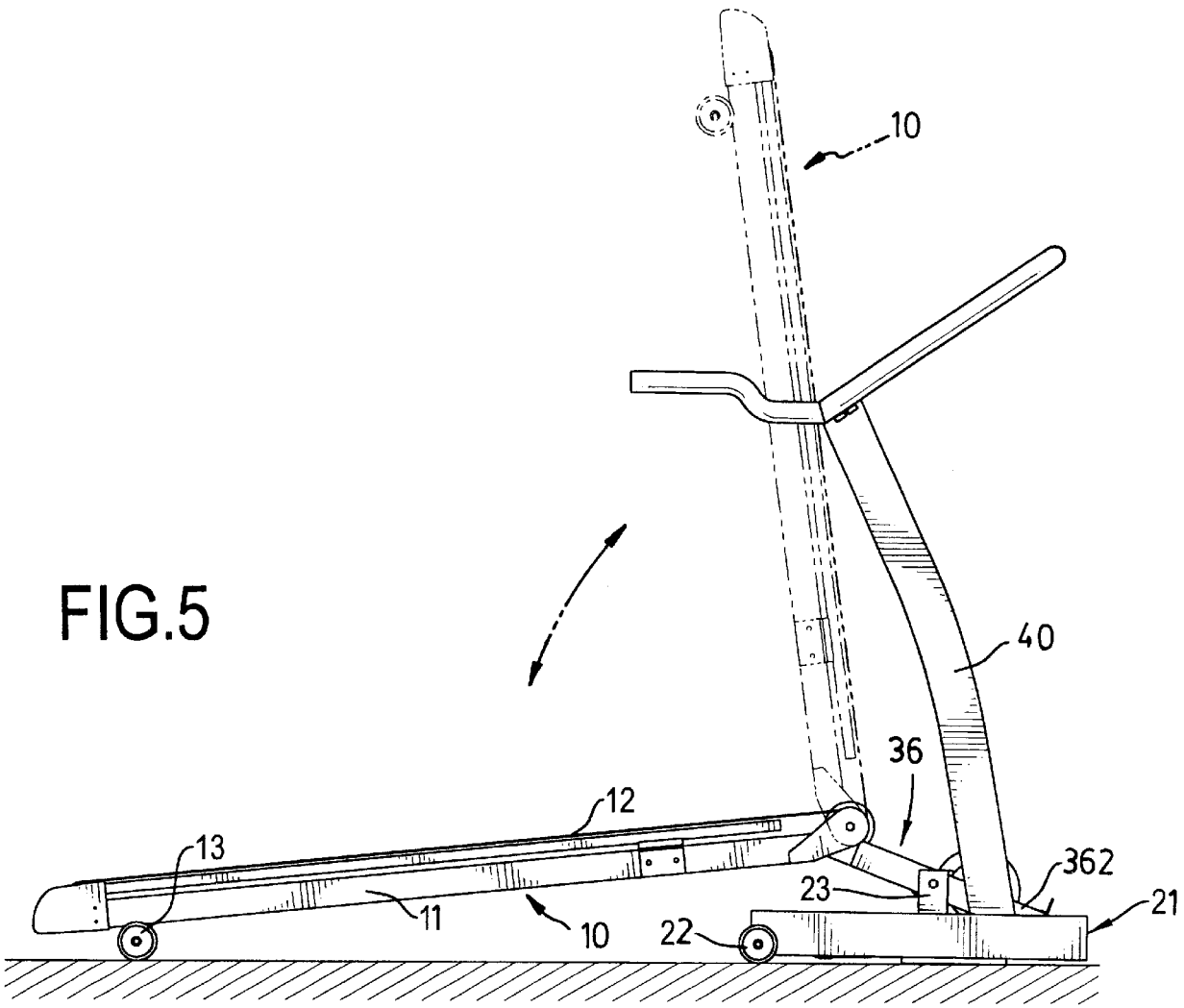
FIG. 5 is an operational side plan view of the treadmill in FIG. 1 showing the treadmill is foldable.

With reference to FIG. 5, the tread assembly (10) can be folded against the front support (40) because the front of the tread frame (11) is pivotally connected to the coupling ends of the coupling arms (362). Therefore, the treadmill will occupy a minimum space while the treadmill is not in use or is transported.

Figure 6A:
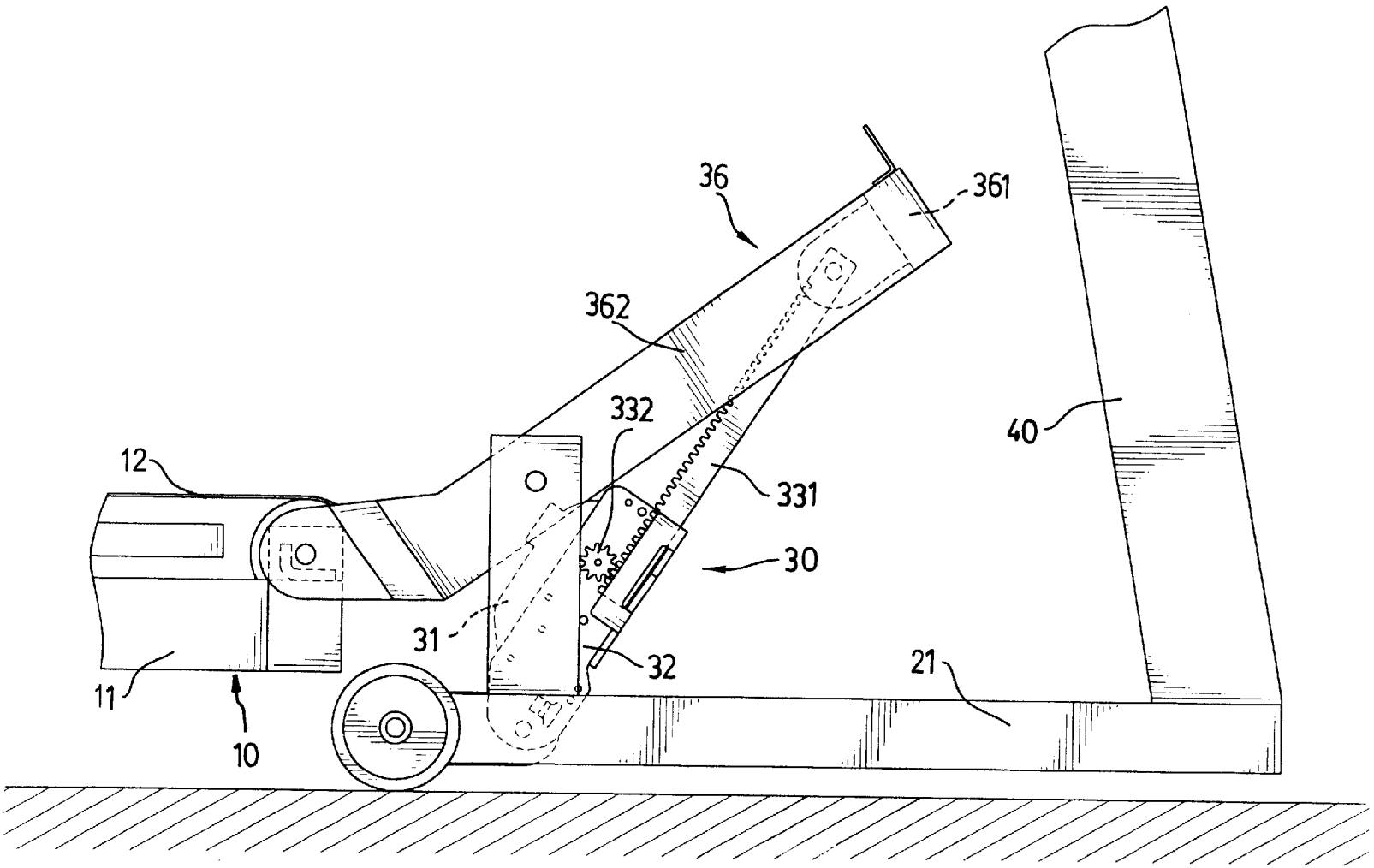
FIG. 6*a* is an enlarged side plan view of a second embodiment of the inclination mechanism in accordance with the present invention.

With reference to FIG. 6*a*, a second embodiment of an inclination mechanism for a treadmill in accordance with the present invention can be implemented with all the elements of the first embodiment except for the adapter bar (34) and the lift rod (35). The front end of the rack (331) is directly connected pivotally to the center of the cross member (361) of the lever arm (36) and the chassis (32) is pivotally attached to the base frame (21). As the rack (331) is driven forward by the pinion (332), the cross member (361) of the lever arm (36) is raised and the front of the tread assembly (10) is lowered which decreases the inclination of the tread assembly (10). In a similar manner, the cross member (361) is lowered and the front of the tread assembly (10) is raised as the rack (331) is retracted which increases the inclination of the tread assembly (10). Therefore, the inclination of the treadmill tread frame (11) is adjustable.

Figure 6B:
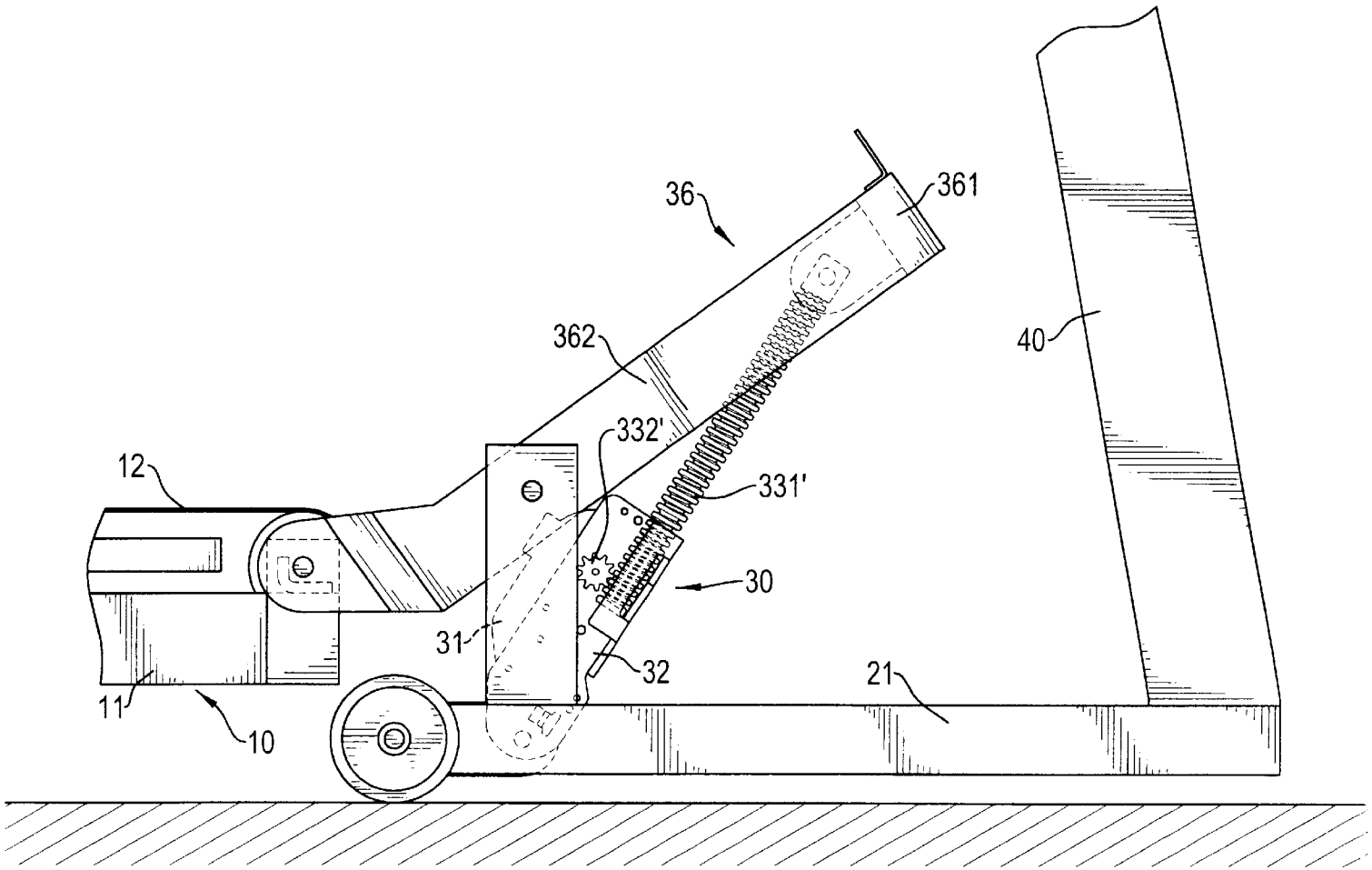
FIG. 6*b* is an enlarged side plan view of an alternative embodiment of a second embodiment of an inclination mechanism in accordance with the present invention.
Figure 7:
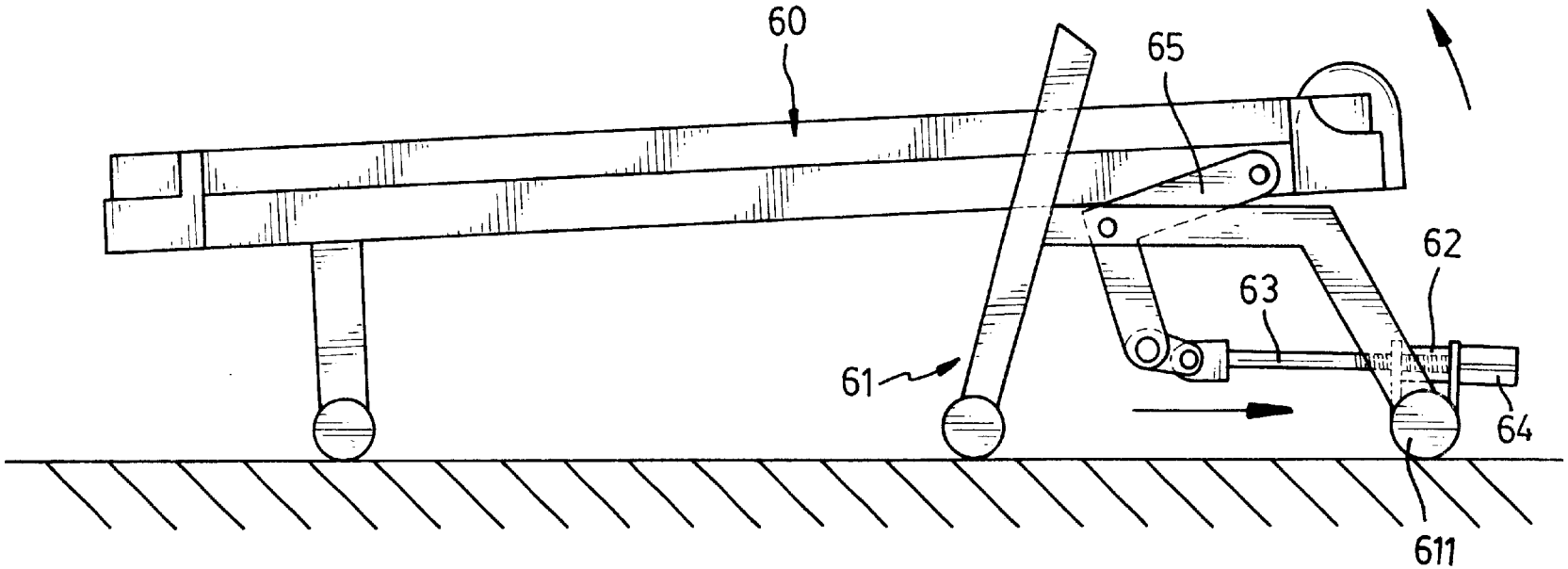
FIG.7 PRIOR ART
FIG. 7 is a side plan view of a treadmill with a conventional inclination device in accordance with the prior art.

With reference to FIG. 6*b*, an alternative embodiment of the second embodiment of an inclination mechanism for a treadmill in accordance with the present invention can be implemented with all the elements of the second embodiment. The drive rod in the foregoing description can be implemented with a worm (331') and worm gear (332') that is attached to the shaft of the motor (31). The worn (331') has a front end (not numbered), which is directly connected pivotally to the center of the cross member (361) of the lever arm (36) and the chassis (32) is pivotally attached to the base frame (21). As the worm (331') is driven forward by the worm gear (332'), the cross member (361) of the lever arm (36) is raised and the front of the tread assembly (10) is lowered which decreases the inclination of the tread assembly (10). In a similar manner, the cross member (361) is lowered and the front of the tread assembly (10) is raised as the worm (331') is retracted which increases the inclination of the tread assembly (10). Therefore, the inclination of the treadmill tread frame (11) is adjustable.

The inclination mechanism for the front of the treadmill tread frame is powered by the motor (31) that can be electrically connected to a control box (not shown) attached to the top of the front support (40). Controlling the revolutions of the motor shaft is conventional so the rack (331) can be extended or retracted easily to increase or decrease the inclination of the tread assembly (10), even when a person is using the treadmill.

Furthermore, the tread frame (11) is easily folded against the front support (40) to minimize the volume of the treadmill for storage or transportation because the tread frame (11) is pivotally attached to the coupling ends of the coupling arms (362).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inclination mechanism for a treadmill having a tread frame with a front, and the inclination mechanism comprising:

a base frame having a cross bar, a top, two opposite sides adapted to mount and attach underneath the front of the tread frame and two posts respectively formed upright from the top of the base frame at each side;

a lever arm having a cross member with a center and two coupling arms, each coupling arm having a coupling end adapted to be pivotally connected to the front of the tread frame of the treadmill and each coupling arm pivotally attached to one of the posts of the base frame at a pivot point between the cross member and the coupling end of the coupling arm;

a chassis having a first side and a second side opposite to the first side, and pivotally attached to the cross bar of the base frame of the treadmill; and an actuating assembly attached to the second side of the chassis and having a drive rod, the drive rod movably mounted in the actuating assembly and having a front end pivotally attached to the cross member of the lever arm;

wherein the cross member of the lever arm is moved by the drive rod thereby changing the inclination of the tread frame of the treadmill.

2. The inclination mechanism as claimed in claim 1, wherein the drive rod is a rack having the front end, the front end of the rack is pivotally attached to the center of the cross member of the lever arm; and the actuating assembly further comprises a motor with a shaft attached to the first side of the chassis, and the shaft of the motor extending through the chassis from the first side to the second side; and a pinion attached to the shaft of the motor at the second side of the chassis and engaging the rack to drive the rack moving.

3. The inclination mechanism as claimed in claim 1, wherein the drive rod is a worm having the front end, the front end of the worm is pivotally attached to the center of the cross member of the lever arm; and the actuating assembly further comprises a motor with a shaft attached to the first side of the chassis and the shaft of the motor extending through the chassis from the first side to the second side; and a worm gear attached to the shaft of the motor at the second side of the chassis and engaging the worm to drive the worm moving.

4. The inclination mechanism as claimed in claim 2, wherein the inclination mechanism further comprises a cross adapter bar adapted to slidably mount in the base frame of the treadmill, and the front end of the rack attached to the cross adapter bar; and a curved lift rod with a first end and a second end, the first end pivotally attached to the cross adapter bar corresponding to the front end of the rack, and the second end pivotally attached to the center of the cross member of the lever arm.

5. The inclination mechanism as claimed in claim 3, wherein the inclination mechanism further comprises a cross adapter bar adapted to slidably mount in the base frame of the treadmill and the front end of the worm attached to the cross adapter bar; and a curved lift rod with a first end and a second end, the first end pivotally attached to the cross adapter bar corresponding to the front end of the worm, and the second end pivotally attached to the center of the cross member of the lever arm.

* * * * *